US007661908B1

(12) United States Patent
Kundel, Sr.

(10) Patent No.: US 7,661,908 B1
(45) Date of Patent: Feb. 16, 2010

(54) TRENCH SHIELD WITH ADJUSTABLE VERTICAL PANELS

(76) Inventor: Robert Kundel, Sr., 292 Forrest St., NW., Warren, OH (US) 44484

( * ) Notice: Subject to any disclaimer, the term of this patent is extended or adjusted under 35 U.S.C. 154(b) by 6 days.

(21) Appl. No.: 12/221,973

(22) Filed: Aug. 8, 2008

(51) Int. Cl.
*E02D 5/02* (2006.01)
*E02D 5/00* (2006.01)

(52) U.S. Cl. ..... 405/274; 405/272; 405/276; 405/282

(58) Field of Classification Search ..... 405/151, 405/153, 274, 276–277, 282–283; 403/21; 411/84–85
See application file for complete search history.

(56) References Cited

U.S. PATENT DOCUMENTS

| | | | | | |
|---|---|---|---|---|---|
| 771,426 | A | * | 10/1904 | Harder | 405/281 |
| 942,653 | A | * | 12/1909 | Louque | 405/256 |
| 3,335,573 | A | * | 8/1967 | Ward | 405/282 |
| 3,606,757 | A | | 9/1971 | De Weese et al. | |
| 4,056,940 | A | | 11/1977 | Fisher | |
| 4,059,964 | A | | 11/1977 | Pavese | |
| RE30,185 | E | | 1/1980 | Griswold | |
| 4,274,763 | A | | 6/1981 | Krings | |
| 4,376,599 | A | | 3/1983 | Krings | |
| 5,078,360 | A | | 1/1992 | Spera | |
| 5,096,334 | A | | 3/1992 | Plank | |
| 5,302,054 | A | | 4/1994 | Winkler et al. | |
| 5,310,290 | A | | 5/1994 | Spencer | |
| 5,503,504 | A | | 4/1996 | Hess et al. | |
| 5,527,137 | A | * | 6/1996 | Spencer | 405/283 |
| 5,533,838 | A | | 7/1996 | Kundel | |
| 5,669,738 | A | | 9/1997 | Kundel | |
| 6,964,540 | B1 | * | 11/2005 | Foxwell | 405/1 |
| 7,021,868 | B1 | | 4/2006 | Farrag et al. | |
| 7,048,471 | B2 | | 5/2006 | Kadiu | |
| 7,311,470 | B2 | * | 12/2007 | Weyant et al. | 405/284 |

* cited by examiner

*Primary Examiner*—David J Bagnell
*Assistant Examiner*—Benjamin Fiorello
(74) *Attorney, Agent, or Firm*—Robert J. Herberger

(57) ABSTRACT

A trench shoring or shielding unit, for securing the sidewalls of an earthen formation, trench or excavation, includes a plurality of adjustable, vertically arranged panels forming a protective wall. As a shielding unit, two opposing protective walls are spaced and attached by at least two spreader bars. Each adjustable panel has opposing top and bottom ends, a C-shaped channel traversing the panel's height, and opposing side edges that inter-engage with the side edges of adjacent panels. Further, each adjustable panel is attached to at least one of two or more whalers along an inner surface of the panel by a clamp-like fastener having a bolt passing through the whaler and into the C-shaped channel of the corresponding panel. The inter-engaging side edges are segmented, preferable concave and convex, so that adjacent adjustable panels inter-engage to resist lateral torque or twisting that may be caused by shifting or collapse of the excavation.

15 Claims, 8 Drawing Sheets

TRENCH SHIELD WITH ADJUSTABLE VERTICAL PANELS

BACKGROUND OF THE INVENTION

1. Field of the Invention

This invention relates generally to a trench shielding unit for securing the sidewalls of a trench or excavation from cave-in, and particularly to a trench shielding unit having adjustable vertical panels to improve access and protection of workers and to underground utilities traversing the excavation area.

2. Description of the Prior Art

In construction, it is often required to excavate underground utilities such as water, gas or sewer lines, pipes, cables, drainage conduit and/or culverts, by digging ditches, trenches and the like of various lengths and depth. Trench shielding units are often used to protect workers and property from cave-ins or landslides by safeguarding against shifts or the collapse of the walls of the excavation. In fact, Occupational Safety and Health Administration (OSHA) regulations require that any excavation over five feet deep be properly shielded to prevent cave-ins or to protect workers inside an excavation in the event of a cave-in.

By contrast, shoring is often used as a more permanent landscaping structure to prevent the sidewall of earthen formations from moving or collapsing, so as not to damage nearby building foundations, shorelines, walkways, bridges, roadways or other architectural structures. More particularly, the positive supporting of a sidewall in this field is called "shoring" while the protection against collapse is called "shielding."

As previously stated, the current practice in the construction industry is to use a trench shielding unit inside an excavation to protect workers, equipment and underground structures. These units are generally open between opposing walls and at the bottom so that digging can continue while the unit is in place. Of course, the top of the unit is also open for easy access by workers and machinery for removal of dirt or other debris, as well as pipe, equipment and/or tools.

Generally, the structure of a trench unit includes opposing side panels to hold the excavation in place. Additionally, the trench unit has a plurality of bars or beams, more commonly referred to as spreader bars, that transverse the lateral width of the trench unit to hold opposing side panels in spaced relationship. Upon completion of the excavation work, the trench unit is either removed or abandoned in place, and the excavation site is filled.

There are a variety of trench units in use, such as, for example, U.S. Pat. No. Re. 30,185 to Griswold which shows a typical trench shield assembly having protective sidewalls maintained in space relation by spreader bars. Further, U.S. Pat. No. 5,310,290 to Viollaz shows another such shielding unit having legs which telescopically adjust to provide clearance about a structure traversing the trench. Further yet, the shoring unit shown in U.S. Pat. No. 7,021,868 to Farrag et al. describes a lightweight unit that can be assembled above ground and lowered into the excavation to accommodate access to utility pipelines traversing the excavation area, in addition to protecting the worker from sidewall collapse. None of these systems, however, is able to accommodate easily and quickly unplanned obstructions or unanticipated traversing structures passing through the trench.

This invention improves the current field of trenching units by providing opposing sidewalls having a plurality of interengaging panels that are easily adjustable vertically without sacrificing structural strength and reliability of the unit.

SUMMARY OF THE INVENTION

An embodiment of this trench shield includes opposing protective walls, with each protective wall being formed by a plurality of adjustable, vertical panels having interengaging side edges. Each vertical panel has a height, opposing top and bottom ends, and a channel traversing the panel's height. Further, each adjustable panel is easily attached to a whaler, along an inner surface of the panel, by a fastener having a shank passing through a wall of the whaler to the corresponding channel of the panel. The channel is used to clamp the panel to the whaler by way of a retaining washer and nut secured against an inside of the channel and tightened by threads against the whaler. Further, the side edges of adjacent panels are segmented to inter-engage, preferably being concave and convex, respectively, to restrict twisting or torque of the panels caused by shifting or collapse of the excavation.

Notably, this invention is versatile. It allows for easy adjustment and securing of each panel in the desired vertical position to allow underground utilities or other known or unknown obstructions to pass through the excavation at various angles and elevations.

Further, this invention provides improved safety for workers, equipment, material and machinery, and provides the workers more flexibility, without sacrificing structural strength. In particular, the panels may be raised or lowered while in the trench as excavating continues inside the protective walls of the unit. More specifically, the invention facilitates small and large adjustments of individual panels, allowing the worker to adjust by lifting or lowering each panel individually as needed while the unit is in place.

Further yet, the engaging side edges of the adjustable vertical panels are strong and adjust easily into a composite shielding structure that is a safe work environment.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

Having generally described the nature of the invention, reference will now be made to the accompanying drawings used to illustrate and describe the preferred embodiments thereof. Further, these and other advantages will become apparent to those skilled in the art from the following detailed description of the embodiments when considered in the light of these drawings in which.

DESCRIPTION OF THE PREFERRED EMBODIMENT

Figure 1:
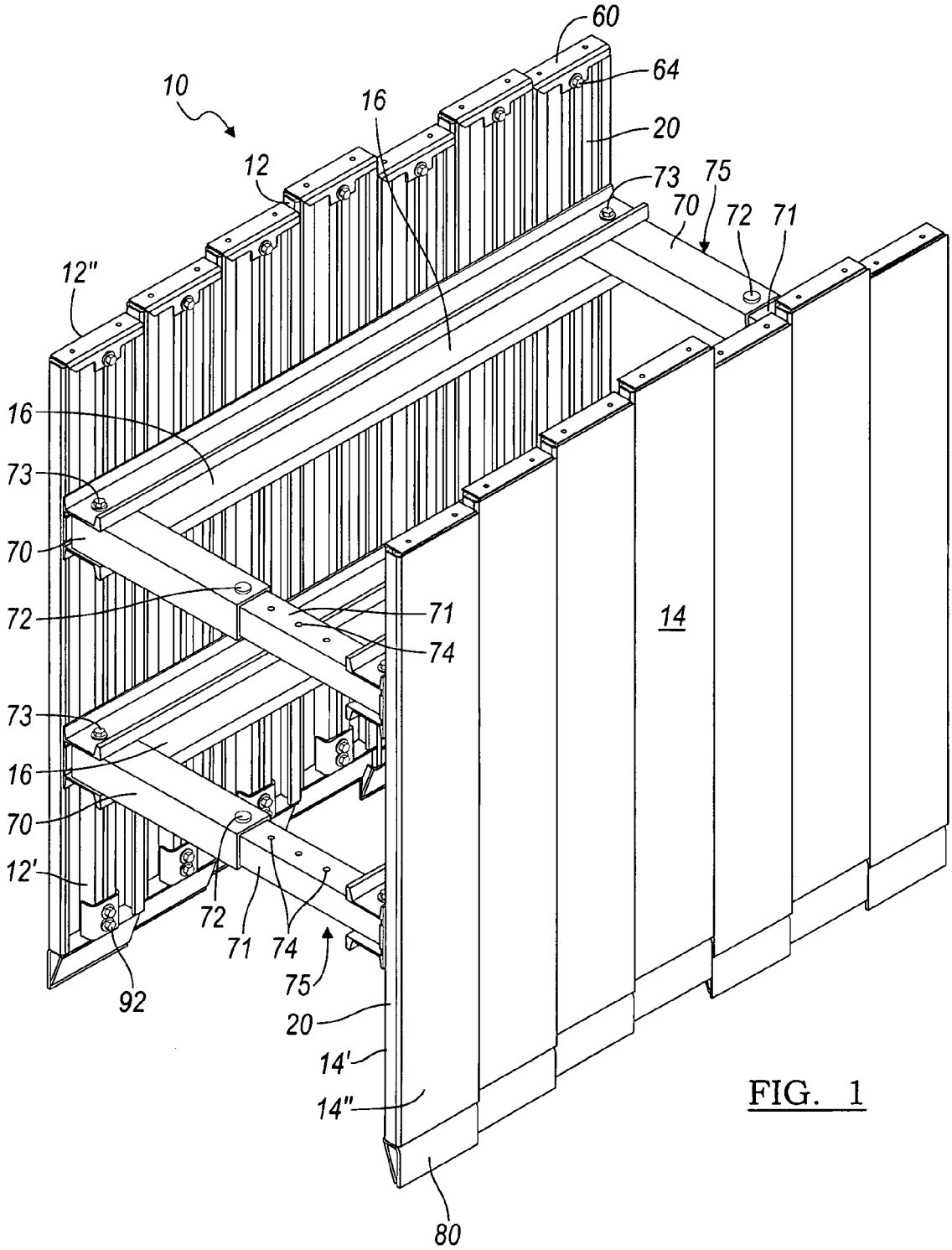
FIG. 1 is a prospective view of the preferred embodiment of a trench shielding unit.
Figure 7:
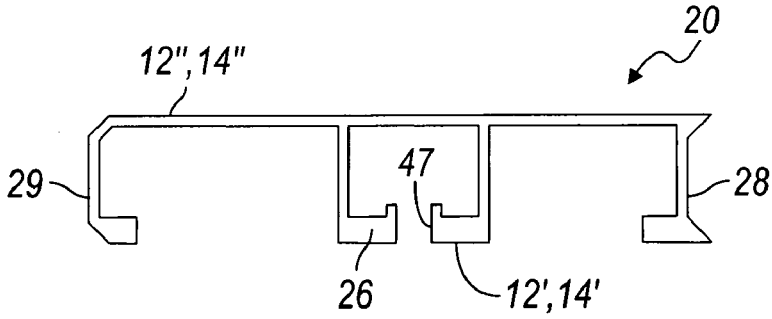
FIG. 7 is a top view of a panel.

Referring to FIGS. 1 and 7, a trench shielding unit 10 includes opposing first and second sidewalls 12, 14, with each sidewall having an inside face 12', 14' and an outside face 12", 14." Each sidewall 12, 14 includes a plurality of vertical panels 20, each panel having a height and opposing concave and convex side edges 28, 29, respectively, which extend along the full height of the panel for inter-engaging with its adjacent panels. Each vertical panel 20 also includes a C-shaped channel 26 having a constant width traversing the panel's height at its center.

Figure 5:
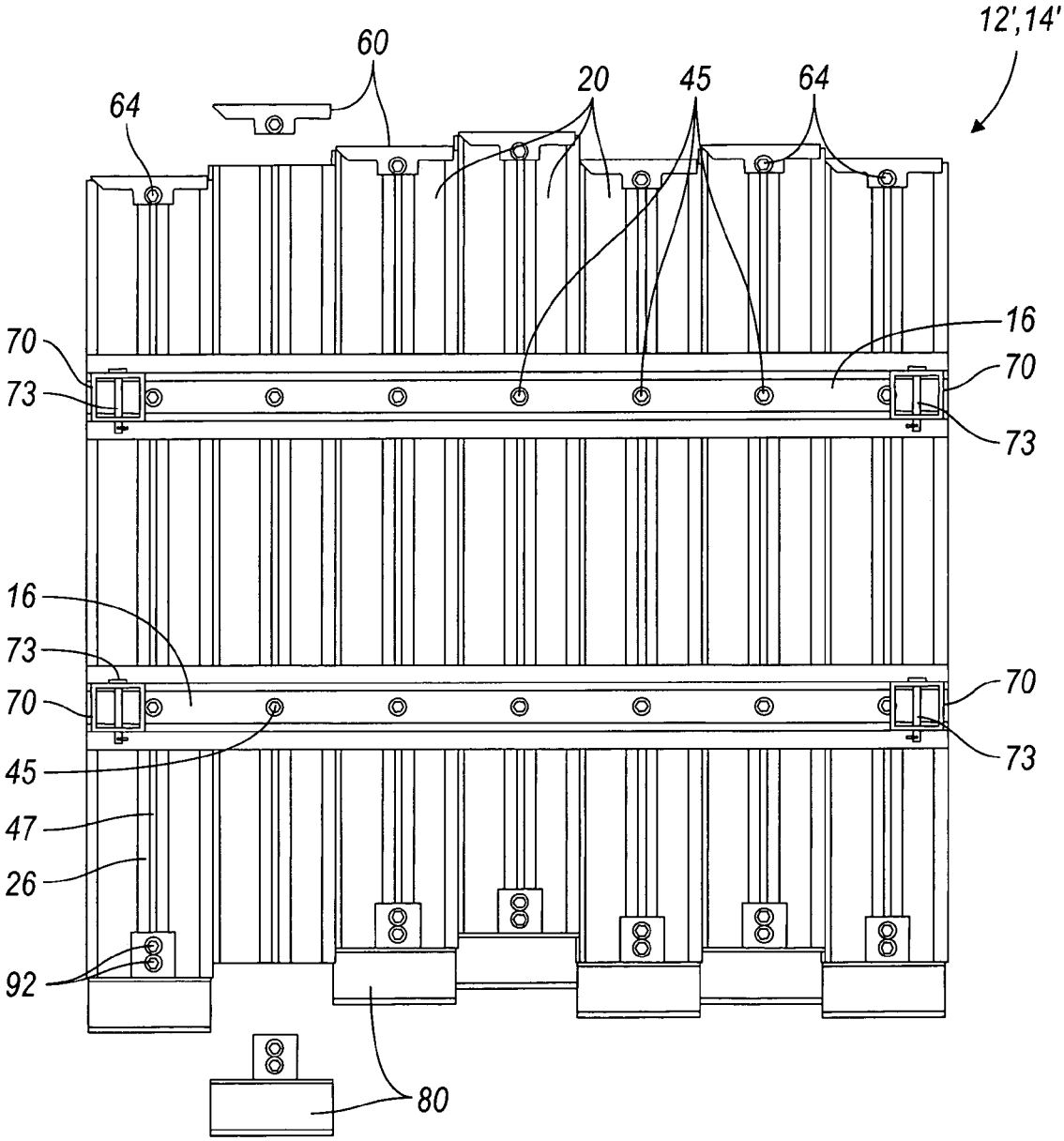
FIG. 5 is a side view of a sidewall taken along plane 5-5 of FIG. 4 showing a bottom cutting edge and top pounding plate spaced from the wall.
Figure 6:
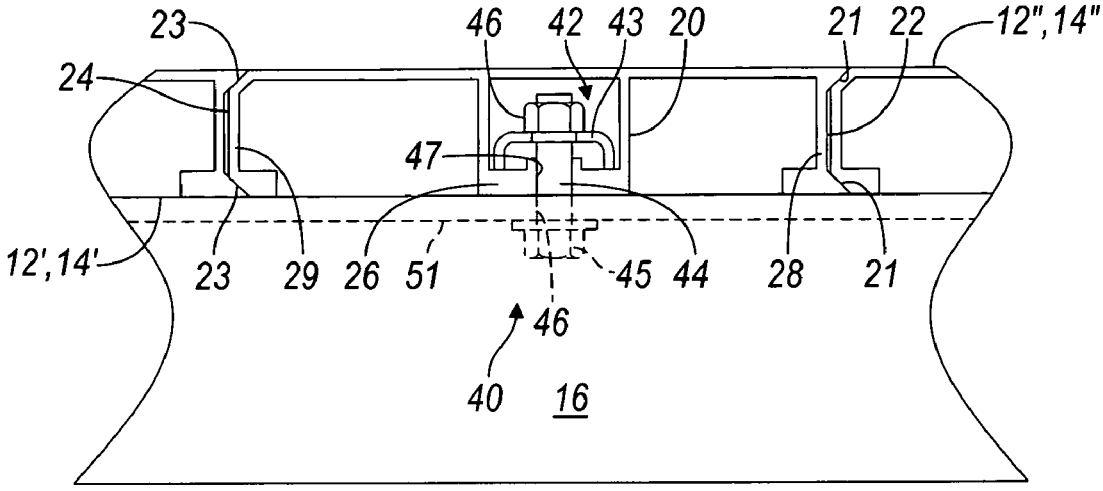
FIG. 6 is a top view of a panel of a sidewall attached to a whaler with the top plate removed and showing partial adjacent panels.
Figure 8:
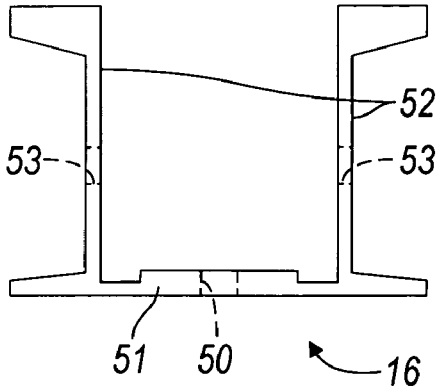
FIG. 8 is an end view of a whaler.
Figure 9A:
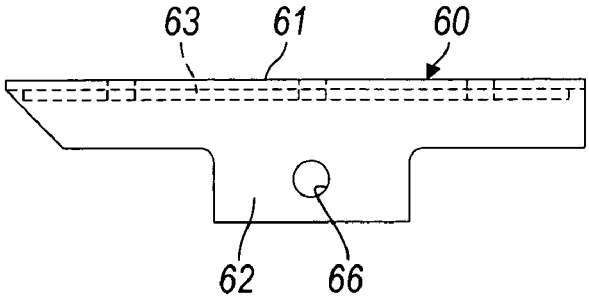
FIG. 9A is an side view of a top plate.
Figure 9B:
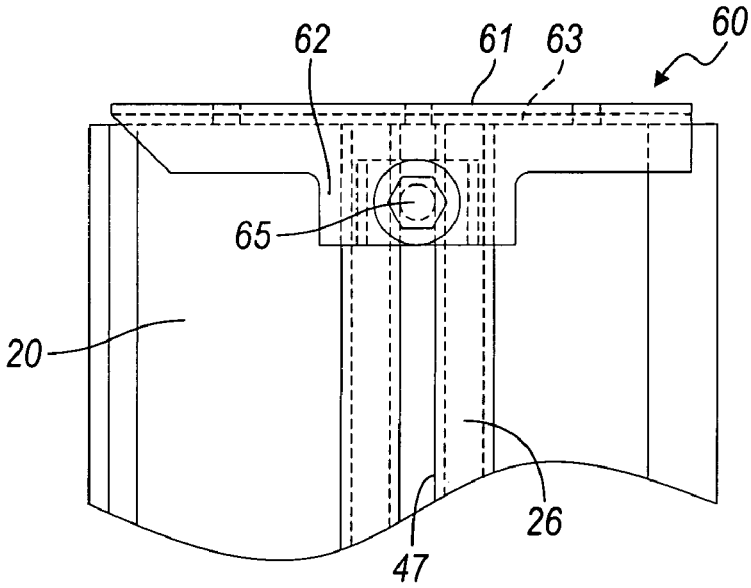
FIG. 9B is a side view showing a top plate attached to a panel.
Figure 9C:
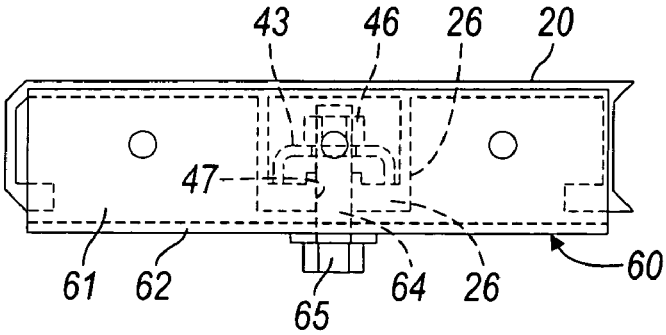
FIG. 9C is a top view showing a top plate attached to a panel.

As shown in FIG. 5, two longitudinal beams 16, also known as whalers, each of which traverses the length of the trench unit 10 along an inside face 12', 14' of a sidewall 12, 14, are each secured to each panel 20 of the respective sidewall 12, 14. Each whaler 16 has a U-shaped cross section, as shown in FIG. 8. Each panel 20 is secured to each corresponding whaler 16 by a clamp-like fastener 42, which includes a threaded fastener 40 and a retaining washer 43 having a nut 46 secured thereto, preferably by a weld, as best seen in FIGS. 6 through 8. More specifically, each panel 20 is attached at its inner surface 12', 14' by the fastener 40, whose threaded shank 44 passes through a hole 50 in the whaler engagement wall 51, through an opening 47 in the C-shaped channel 26 of the panel 20, and through a central hole in washer 43. The panel 20 is then secured to the whaler 16 using fastener 40 by securing the head 45 of fastener 40 against the whaler wall 51, and driving the nut 46 into engagement with the threaded shank 44 such that the attached retaining washer 43 is located within the C-shaped channel 26 of the panel 20. The width of the retaining washer 43 is noncircular and slightly smaller than the width of the C-shaped channel 26; therefore, the nut 46 and washer 43 are prevented from rotating within the channel 26 when the fastener head 45 is tightened and loosened on the nut 46.

Figure 4:
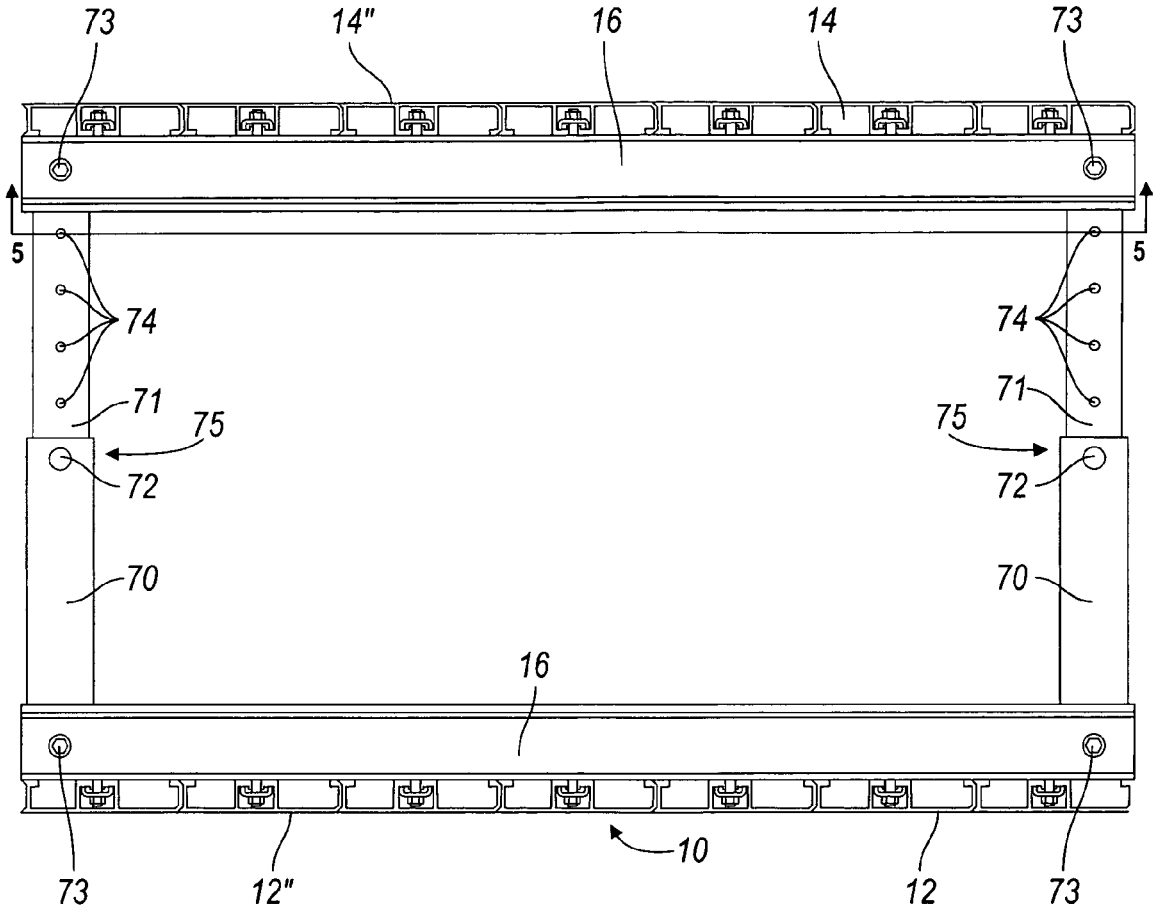
FIG. 4 is a cross sectional view taken along plane 4-4 of FIG. 3.

FIGS. 6 and 7 show that each panel 20 is formed with a concave edge 28 and a convex edge 29, located at the opposite side from the concave edge. The panels 20 are assembled such that the convex edge 29 of one panel nests in the concave edge 28 of the adjacent panel as seen in FIG. 4. Again viewing FIGS. 6 and 7, the concave edge 28 is formed by beveled surfaces 21 and a flat surface 22. The convex edge 29 is formed by beveled surfaces 23 and a flat surface 24. Any twisting or bending of panel 20 is resisted by contact engagement of its beveled surfaces 21, 23 with the corresponding beveled surfaces of the immediately adjacent panels. As an alternative, the flat surface 22, 24 may be scored with traversing teeth for added inter-engagement with the adjacent panels.

Figure 2:
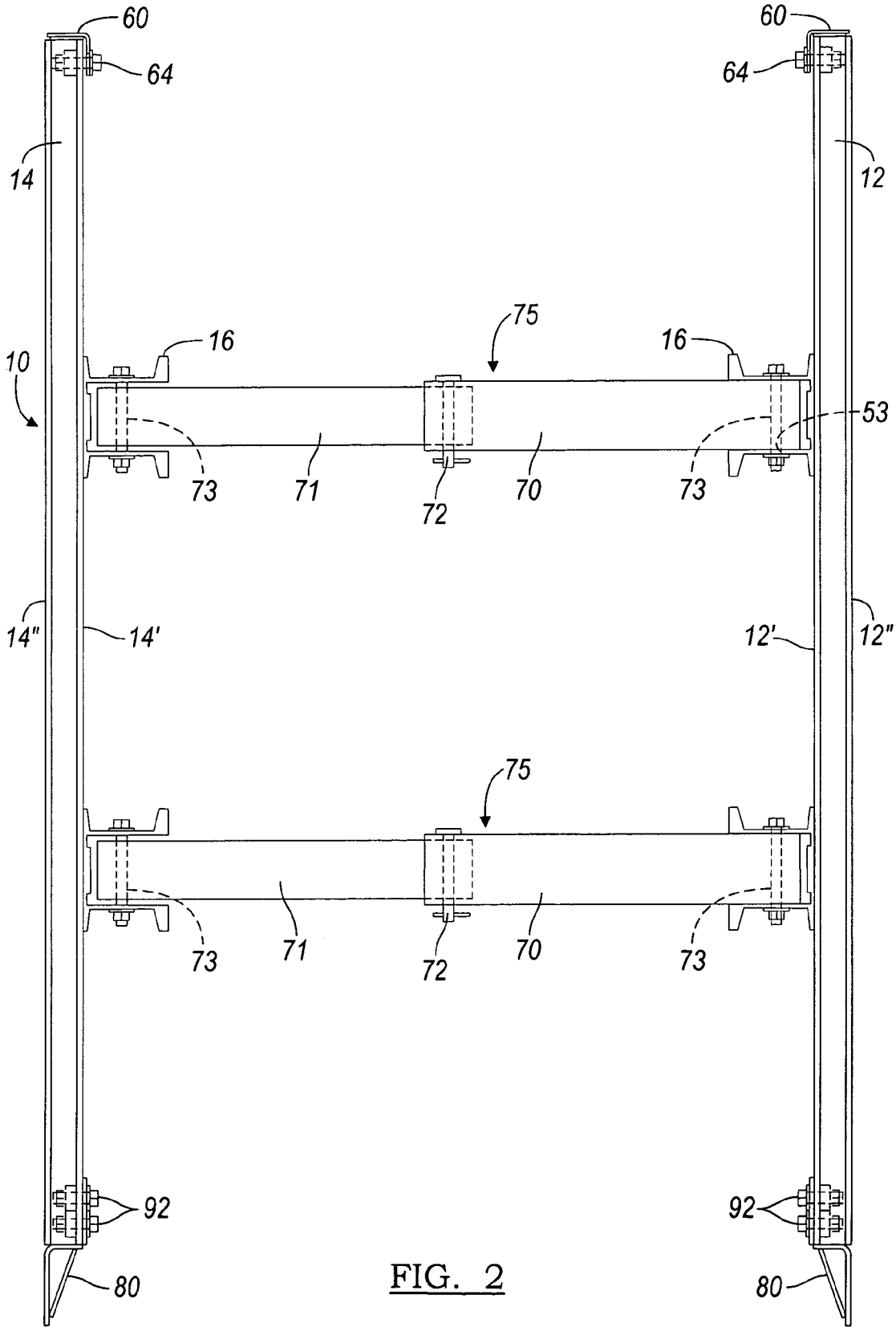
FIG. 2 is an end view of the trench shielding unit shown in FIG. 1.

As best seen in FIGS. 1 and 2, the opposing first and second sidewalls 12, 14 are spaced mutually across the width of the trench shielding unit 10 by upper and lower spreader bars 75, located at oppose ends of the unit. One end of each spreader bar 75 is fitted into the channel of a whaler 16 located at one of the sidewalls 12, 14 and is secured to that whaler by an attachment pin 73, which passes through the holes 53 in the legs 52 of the whaler, best seen in FIG. 8. The width of the trench shielding unit 10 is incrementally adjustable because the male spreader bar component 71 is telescopically engaged in the female spreader bar component 70, and the spreader bar components are interconnected by bolts or pins 72 fitted in holes 74 mutually spaced along the length of the male spreader bar component 71 and a hole in the female spreader bar component 70. The incrementally adjustable length of the spreader bars 75 is typically established during assembly, before the trench unit 10 is placed inside the excavation.

Referring to FIGS. 1, 9A, 9B and 9C, the upper end of each panel 20 is fitted with a top plate 60 in the form of an angle having a top leg 61, a side leg 62 and a doubler 63, located under and secured to the top leg. The side leg 62 is secured to the panel 20 by a threaded fastener 64, whose head 65 bears against leg 62 and whose shank passes through a hole 66 in leg 62, through the opening 47 in the C-channel 26 of the panel 20 and through a hole in the retaining washer 43. The nut 46 is secure to the washer 43 so that they are retained as a unit in the C-shaped channel, as previously described with reference to attachment of the panels 20 to the whaler 16. Specifically, the width of the retaining washer 43 is noncircular and slightly smaller than the width of the C-shaped channel 26; therefore, the nut 46 and washer 43 are prevented from rotating within channel 26 when the fastener head 65 is tightened and loosened on the nut 46.

Figure 10A:
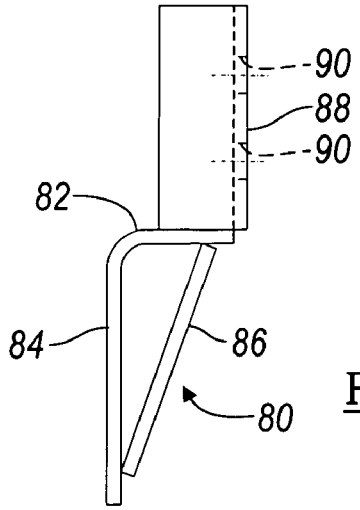
FIGS. 10A and 10B are side and front views, respectively, of a knife edge assembly.
Figure 10B:
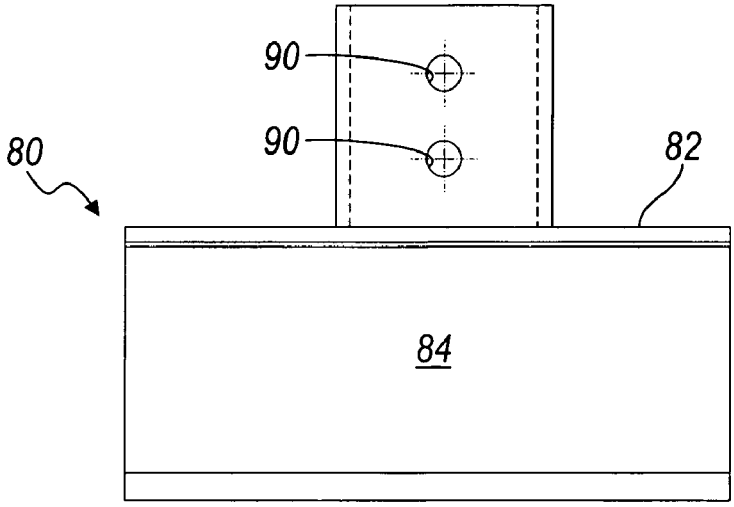

Referring to FIGS. 1 and 5, the lower end of each panel 20 is fitted with wedge assembly 80. Referring now to FIGS. 10A and 10B, each wedge assembly 80 includes an angle having a lateral leg 82 and a vertical leg 84, an inclined gusset 86 welded to the legs 82, 84, and a channel 88 welded to the lateral leg 82. The web of the channel 88 is formed with two holes 90. Gusset 86 and leg 84 form a wedge that facilitates staking the lower end of each panel 20 in the ground when force is applied to the top plate 60.

Figure 11:
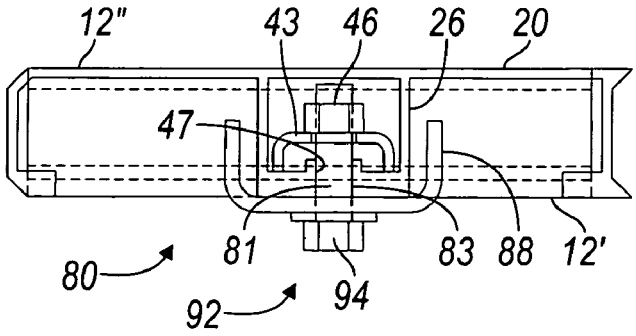
FIG. 11 is top sectional view of the wedge assembly attached to a panel.

FIG. 11 shows that the wedge assembly 80 secured to the lower end of the panel 20 by installing the channel 88 over the C-channel 26 such that the web of channel 88 is adjacent the inner surface 12' of the panel 20. The web of channel 88 is secured to the panel 20 by inserting the shank of a threaded fastener 92 into each of the holes 90 in the channel, through the opening 47 in C-channel 26 and through the holes in a retaining washer 43, which are aligned with holes 90. Again, nut 46 is secure to its respective washer 43 as described above. The head 94 of each fastener 92 bears against channel 88. The width of the retaining washer 43 is noncircular and slightly smaller than the width of the C-shaped channel 26; therefore, the nut 46 and washer 43 are prevented from rotating within channel 26 when the fastener head 94 is tightened and loosened on the nut 46.

Figure 3:
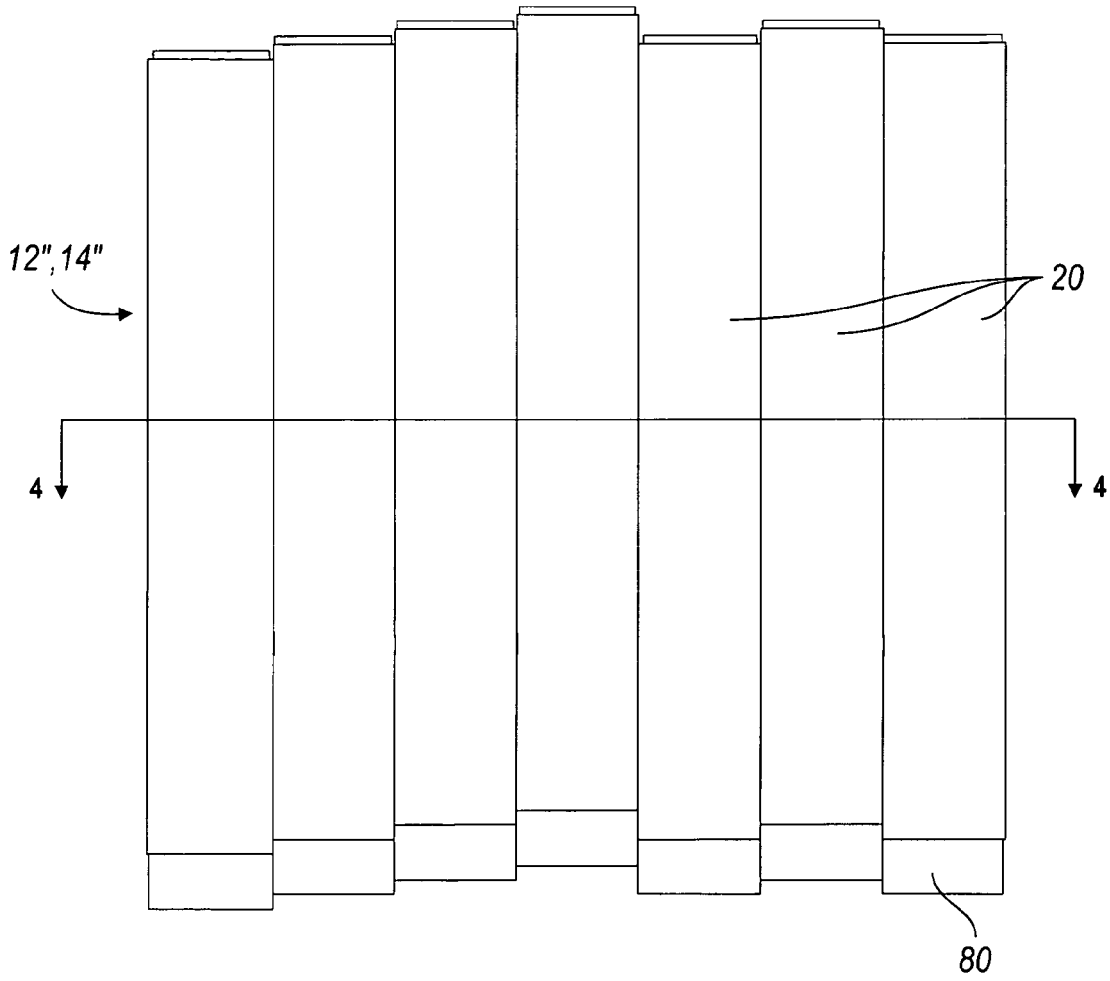
FIG. 3 is a side view showing a wall of the shielding unit.

In use, the trench unit 10 is typically assembled outside of the trench to a desired length and width, by assembling the walls 12, 14 using the appropriate length whalers 16 and attaching adjustable panels 20 thereto as shown in FIGS. 3 and 5. Each panel 20 is assembled with its pounding plate 60 and wedge cutting edge 80 attached as described above. The assembled walls 12, 14 are then spaced, raised and attached by the spreader bars 75. Before or after the assembled trench unit 10 is lifted and lowered into the trench, individual panels 20 may be vertically adjusted, as seen in FIGS. 1 and 3, from inside the unit 10 at its inner surfaces 12', 14'. More specifically, fasteners 40 of an individual panel 20 are loosened, but not removed, from the corresponding whaler walls 51 to unsecure the panel 20. The panel is then raised or lowered as the retaining washer 43 of fasteners 40 run along and are retained inside of the panel's C-shaped channel 26. Once in place, the fasteners 40 are re-tightened such that each corresponding retaining washer 43 is secured against the C-shaped channel 26 of the panel 20.

As digging continues and the unit 10 is set, pounded or advanced further into the ground, individual panels 20 of walls 12, 14 may be continually adjusted to accommodate uncovered obstructions and underground utilities, such as traversing water, gas or sewer lines, pipes, cables, drainage conduit and/or culverts, as discussed above.

Notably, the invention described in this application pertains to a shoring unit, as with the shielding unit described herein. It should be further noted that the present invention can be practiced otherwise than as specifically illustrated and described, without departing from its spirit or scope. It is intended that all such modifications and alterations be included insofar as they are consistent with the objectives and spirit of the invention.

What is claimed is:

1. A trench shielding unit comprising:

adjustable panels forming first and second walls, each adjustable panel including a channel, a convex edge and a concave edge, the convex edge having a contact face formed in beveled and straight segments, and the concave edge having a contact face formed in opposing beveled and straight segments, the convex edge of a first one of the panels being facially abutting and engaged without fastening in the concave edge of a second one of the panels;

a first whaler attached to each panel of the first wall at the corresponding channel, the first whaler having a U-shaped cross section with a corresponding back engagement wall and legs extending perpendicular therefrom;

a second whaler attached to each panel of the second wall at the corresponding channel, the second whaler having a U-shaped cross section having a corresponding back engagement wall and legs extending perpendicular therefrom; and at least two spreader bars attached to and extending between the walls; and wherein the engagement of each adjustable panel with its corresponding whaler includes a panel fastener, the panel fastener having a retaining washer fitted in the channel of said corresponding panel, the retaining washer having a hole therein with a threaded section aligned with the hole, and a threaded bolt that includes a head, a shank secured to the head and passing through a one of a plurality of evenly spaced openings along the back engagement wall of the corresponding whaler into said channel, through the hole of the retaining washer and engaged with the threaded section, the head of the bolt forcing the corresponding back engagement wall of the whaler against said channel when secured.

2. The trench shielding unit of claim 1, wherein the retaining washer has a width slightly smaller than a width of the channel, preventing the nut from rotating when engaged by the shank.

3. The trench shielding unit of claim 1, wherein the spreader bars further include:

first and second spreader bars secured on opposing ends of the trench shielding unit to the first whaler and the second whaler in the corresponding U-shaped cross sections.

4. The trench shielding unit of claim 1, wherein the first spreader bar is secured on opposing ends of the trench shielding unit to the first whaler and the second whaler in the corresponding U-shaped cross sections, and the first spreader bar further includes:

a hollow bar;

an adjustment bar fitted within the hollow bar and able to slide along a length of the hollow bar;

one of the hollow bar and the adjustment bar being formed with laterally spaced holes;

the other one of the hollow bar and the adjustment bar being formed with an attachment hole; and an attachment engaged with the attachment hole and one of the spaced holes.

5. The trench shielding unit of claim 1, wherein each adjustable panel further includes a top end, and L-shaped a top plate secured to the top end at the channel.

6. The trench shielding unit of claim 1, wherein each adjustable panel further includes:

a top end;

a top plate;

a washer fitted to the channel of the adjustable panel and having a hole therein;

a threaded nut aligned with the washer hole and secured to the washer; and a threaded top plate fastener that includes a head, a shank secured to the head and passing through a hole in the top plate, into the channel of the panel, through the hole of the washer, and engaged with the nut, so that the head forces the top plate against the channel.

7. The trench shielding unit of claim 1, wherein each adjustable panel further includes a bottom end and a wedge assembly attached to the bottom end at the channel.

8. The trench shielding unit of claim 1, wherein each adjustable panel further includes:

a bottom end;

a wedge assembly having lateral and vertical legs, a wedge fastening channel attached to the lateral leg, and an inclined gusset attached to the legs;

a washer fitted in the channel of each adjustable panel and having a hole therein;

a threaded nut aligned with the washer hole and secured to the washer; and a threaded wedge assembly fastener that includes a head, a shank secured to a head and passing through a hole in the channel of the wedge assembly, into said corresponding channel of the panel, through the hole of the washer, and engaged with the nut, the head forcing the channel of the wedge assembly against the channel of the corresponding panel.

9. A trench shield unit comprising:

panels forming first and second walls, at least some of the panels being adjustable and including a channel, a convex edge, and a concave edge, the convex edge has a contact face formed in beveled and straight segments, and the concave edge has a contact face formed in opposing beveled and straight segments, the convex edge of a first one of the adjustable panels being facially abutting and engaged without fastening in the concave edge of a second one of the adjustable panels to resist displacement due to torsion relative to an adjacent adjustable panel;

first and second whalers located at an inner surface of the first wall, and each adjustable panel of the first wall is engaged at the corresponding channel with the first and second whalers, each whaler having a U-shaped cross section with a corresponding back engagement wall and legs extending perpendicular therefrom;

third and fourth whalers located at an inner surface of the second wall, and each adjustable panel of the second wall is engaged at the corresponding channel with the third and fourth whalers;

at least two spreader bars attached to and extending between the first whaler and the third whaler; and wherein the engagement of each adjustable panel with its corresponding whalers includes panel fasteners, each panel fastener includes a retaining washer fitted in the channel of said corresponding panel, the retaining washer having a hole therein with a threaded section aligned with the hole, and a threaded bolt that includes a head, a shank secured to the head and passing through a one of a plurality of evenly spaced openings along the back engagement wall of the corresponding whaler into said channel, through the hole of the retaining washer and engaged with the threaded section, the head of the bolt forcing the corresponding back engagement wall of the whaler against said channel when secured.

10. The trench shielding unit of claim 9, wherein the retaining washer has a width slightly smaller than a width of the corresponding channel, preventing the threaded section of the panel fastener from rotating when engaged by the shank.

11. The trench shielding unit of claim 10, wherein the spreader bars further include:

first and second spreader bars secured on opposing ends of the trench shielding unit to the first whaler and the third whaler in the corresponding U-shaped cross section of each whaler.

12. The trench shielding unit of claim 10, wherein the spreader bars further include:

first and second spreader bars secured on opposing ends of the trench shielding unit to the first whaler and the third whaler in the corresponding U-shaped cross section of each whaler, and each of the first and second spreader bars further includes:

a hollow bar;

an adjustment bar fitted within the hollow bar and able to slide along a length of the hollow bar;

one of the hollow bar and the adjustment bar being formed with laterally spaced holes;

the other one of the hollow bar and the adjustment bar being formed with an attachment hole; and an attachment engaged with the attachment hole and one of the spaced holes.

13. The trench shielding unit of claim 10, wherein each adjustable panel further includes:

a top end;

a L-shaped top plate; and a plate fastener having a washer fitted in the channel of each adjustable panel with a hole therein, a threaded portion aligned with the washer hole and secured to the washer, a threaded bolt that includes a head, a shank secured to the head and passing through a hole in the top plate, into said corresponding channel, through the hole of the washer, and engaged with the threaded portion, the head forcing the top plate against said channel.

14. The trench shielding unit of claim 10, wherein each adjustable panel further includes:

a bottom end;

a wedge assembly; and a wedge fastener having a washer fitted in the channel of each adjustable panel with a hole therein, a threaded portion aligned with the washer hole and secured to the washer, a threaded bolt that includes a head, a shank secured to the head and passing through a hole in the wedge assembly, into said corresponding channel, through the hole of the washer, and engaged with the threaded portion, the head forcing the wedge assembly against said channel.

15. A trench shield comprising:

panels forming first and second walls, at least some of the panels being adjustable and having a channel, a convex edge, and a concave edge, the convex edge is formed with a contact face having beveled and straight segments, and the concave edge is formed with a mating contact face having opposing beveled and straight segments, the convex edge of a first one of the adjustable panels being facially abutting and engaged without fastening in the concave edge of a second one of the adjustable panels to resist displacement due to torsion relative to an adjacent adjustable panel, each adjustable panel further includes top and bottom ends, a top plate at the top end having a top plate fastener fitted in the corresponding channel, and a wedge assembly at the bottom end having a wedge fastener fitted in the corresponding channel;

first and second whalers, each having a U-shaped cross section with a back engagement wall and legs extending perpendicular therefrom, the first and second whalers being located at an inner surface of the first wall, and each adjustable panel of the first wall is engaged at the corresponding channel with said back engagement walls of the first and second whalers;

third and fourth whalers, each having a U-shaped cross section with a back engagement wall and legs extending perpendicular therefrom, the third and fourth whalers being located at an inner surface of the second wall and each adjustable panel of the second wall is engaged at the corresponding channel with said back engagement walls of the third and fourth whalers; and at least two spreader bars attached to and extending between the first whaler and the third whaler; and wherein the engagement of each adjustable panel with its corresponding whalers includes panel fasteners, and each panel fastener comprises:

a washer having a threaded portion, and the washer fitted in the channel of each adjustable panel having width slightly smaller than a width of the corresponding channel, preventing the threaded portion of the panel fastener from rotating; and a threaded bolt that includes a head, a shank secured to the head and passing through one of a plurality of evenly spaced openings along the back engagement wall of the corresponding whaler, into said channel, and engaged with the threaded portion of the fitted washer, the head of the bolt forcing the corresponding back engagement wall of the whaler against said channel when secured.

* * * * *